US005131770A

United States Patent [19]

Kanemitsu

[11] Patent Number: 5,131,770

[45] Date of Patent: Jul. 21, 1992

[54] SINGLE SLIT DISK FOR DETECTING AMOUNT OF FEED OF SHEET MEMBER

[75] Inventor: Shinji Kanemitsu, Tokyo, Japan

[73] Assignee: Canon Kabushiki Kaisha, Tokyo, Japan

[21] Appl. No.: 375,980

[22] Filed: Jul. 6, 1989

[30] Foreign Application Priority Data

Jul. 7, 1988 [JP] Japan ..... 63-89494[U]

[51] Int. Cl.[5] ..... B41J 19/92

[52] U.S. Cl. ..... 400/568; 400/703

[58] Field of Search ..... 400/162.3, 545, 568, 400/703, 708, 902

[56] References Cited

U.S. PATENT DOCUMENTS

| | | | |
|---|---|---|---|
| 3,917,142 | 11/1975 | Guarderas | 226/38 |
| 4,027,764 | 6/1977 | Kashio | 101/93.15 |
| 4,379,646 | 4/1983 | Maeda | 400/641 |
| 4,530,613 | 7/1985 | Horman | 400/708 |
| 4,683,480 | 7/1987 | Sakamoto | 400/639 |
| 4,892,426 | 1/1990 | Steele | 400/708 |
| 4,934,845 | 6/1990 | Kato | 400/708 |

FOREIGN PATENT DOCUMENTS

| | | | |
|---|---|---|---|
| 0357718 | 8/1989 | European Pat. Off. | 400/708 |
| 2300421 | 7/1974 | Fed. Rep. of Germany | 400/708 |
| 194879 | 11/1984 | Japan | 400/902 |
| 61-144372 | 7/1986 | Japan | 400/708 |
| 90273 | 4/1987 | Japan | 400/568 |
| 218163 | 9/1987 | Japan | 400/568 |
| 63-104862 | 5/1988 | Japan | 400/708 |
| 1400939 | 7/1975 | United Kingdom | 400/708 |

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

The present invention provides a detecting apparatus for detecting an amount of feed of a sheet member. Detecting apparatus comprises a feeding means for feeding a sheet member, a rotary member engaged by the sheet member and rotatingly driven by the sheet member being fed by the feeding means, and an calculating circuit for calculating an amount of feed of the sheet member on the basis of a rotational amount of the rotary member.

15 Claims, 8 Drawing Sheets

SINGLE SLIT DISK FOR DETECTING AMOUNT OF FEED OF SHEET MEMBER

BACKGROUND OF THE INVENTION

1. Field of the Invention

The present invention relates to an apparatus for detecting an amount of feed of a sheet member, which can control a sheet feeding means by detecting the amount of feed of the sheet member.

2. Related Background Art

In a conventional recording apparatus used with a printer, facsimile, word processor and the like, an image was recorded on a recording sheet (to be fed) per a predetermined printing width (per one line) by means of a recording head, and the recording sheet was fed by a predetermined amount (corresponding to the printing width) to effect a line space whenever each line was printed; in this way, the printing operations were repeated to obtain the whole image.

In this case, although the accuracy of the amount of feed of the recording sheet differs in dependence upon resolving power of the character, since the resolving power of the character is normally in the order of 200 dot/inch - 400 dot/inch, the accuracy of the amount of feed of the recording sheet was required to have a value of 60–30 μm. In order to obtain such feed accuracy, the diameter and rotational amount of a feed roller were previously calculated in correspondence to the amount of feed of the recording sheet (to be fed by the feeding roller), and the recording sheet was fed by controlling a driving time of a feed motor for driving the feed roller by means of a CPU.

However, in the above-mentioned conventional recording apparatus, in order to maintain such feed accuracy for the feed amount of the recording sheet, the critical or severe control of parts was required. For example, the accuracy regarding the diameter and/or eccentricity of the feed roller must have been maintained within a value less than 10 μm. Further, even when such severe control of the parts was maintained, if the relative slipping movement occurred between the recording sheet and the feed roller, the above-mentioned accuracy of the feed amount of the recording paper could not often be maintained, thus worsening the quality of the recorded image.

SUMMARY OF THE INVENTION

It is an object of the present invention to provide an apparatus for detecting an amount of feed of a sheet member, which controls a sheet feeding means by directly detecting the amount of feed of the sheet member and which can eliminate the abovementioned conventional drawbacks.

In order to achieve the above object, according to the present invention, there is provided an apparatus for detecting an amount of feed of a sheet member, which comprises a feeding means for feeding the sheet member, and a detecting means for detecting the amount of feed of the sheet member by using a rotary member rotatingly driven by engaging with the sheet member fed by the feeding means and for controlling the feeding means.

According to the present invention, since the feeding means can be controlled by directly detecting the amount of feed of the sheet member fed by the feeding means by means of the detecting means, the sheet member can be positively fed by a predetermined amount with accuracy, thereby maintaining the recorded image with high quality.

DETAILED DESCRIPTION OF PREFERRED EMBODIMENTS

The present invention will now be explained in connection with embodiments wherein the present invention is applied to an ink jet recording apparatus, with reference to the accompanying drawings.

Figure 1:
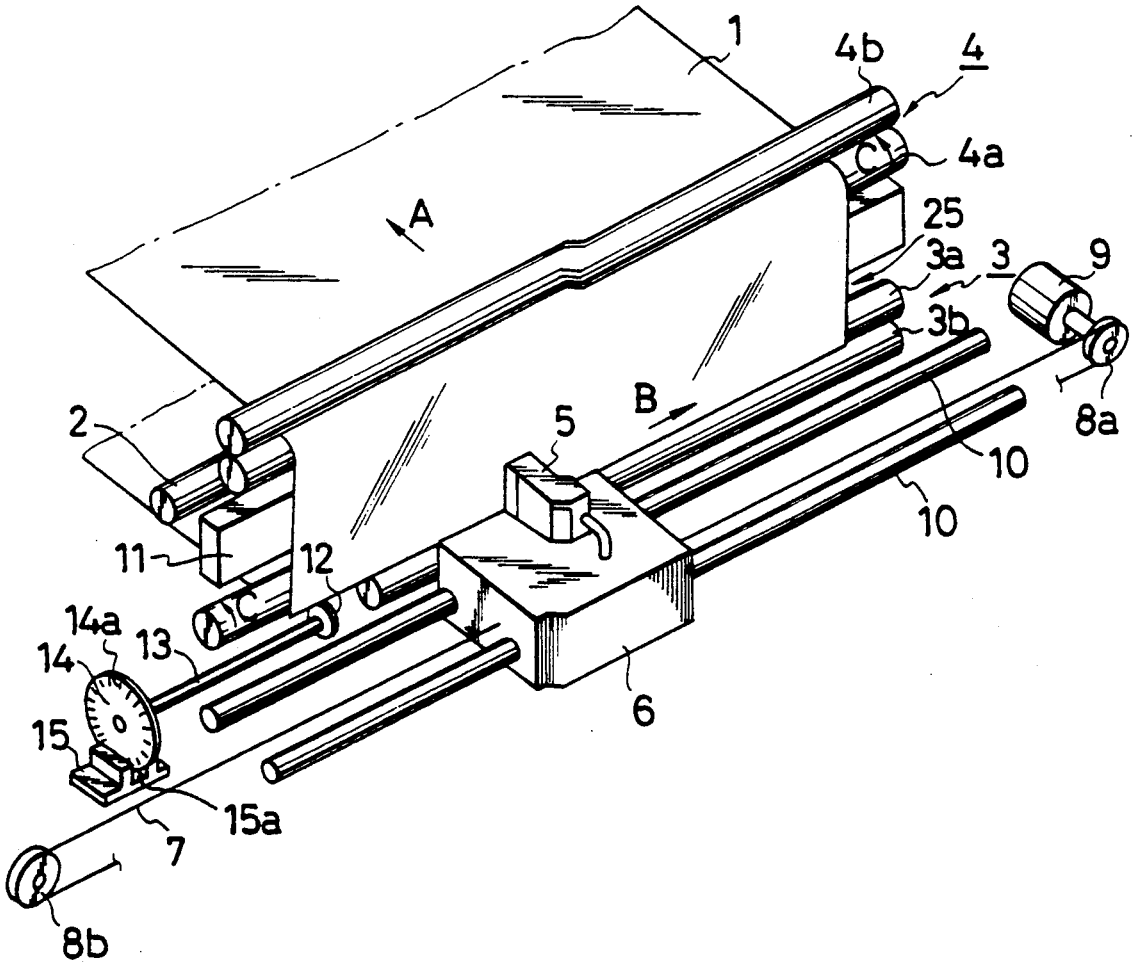
FIG. 1 is a schematic perspective view of an ink jet recording apparatus according to a preferred embodiment of the present invention.
Figure 2:
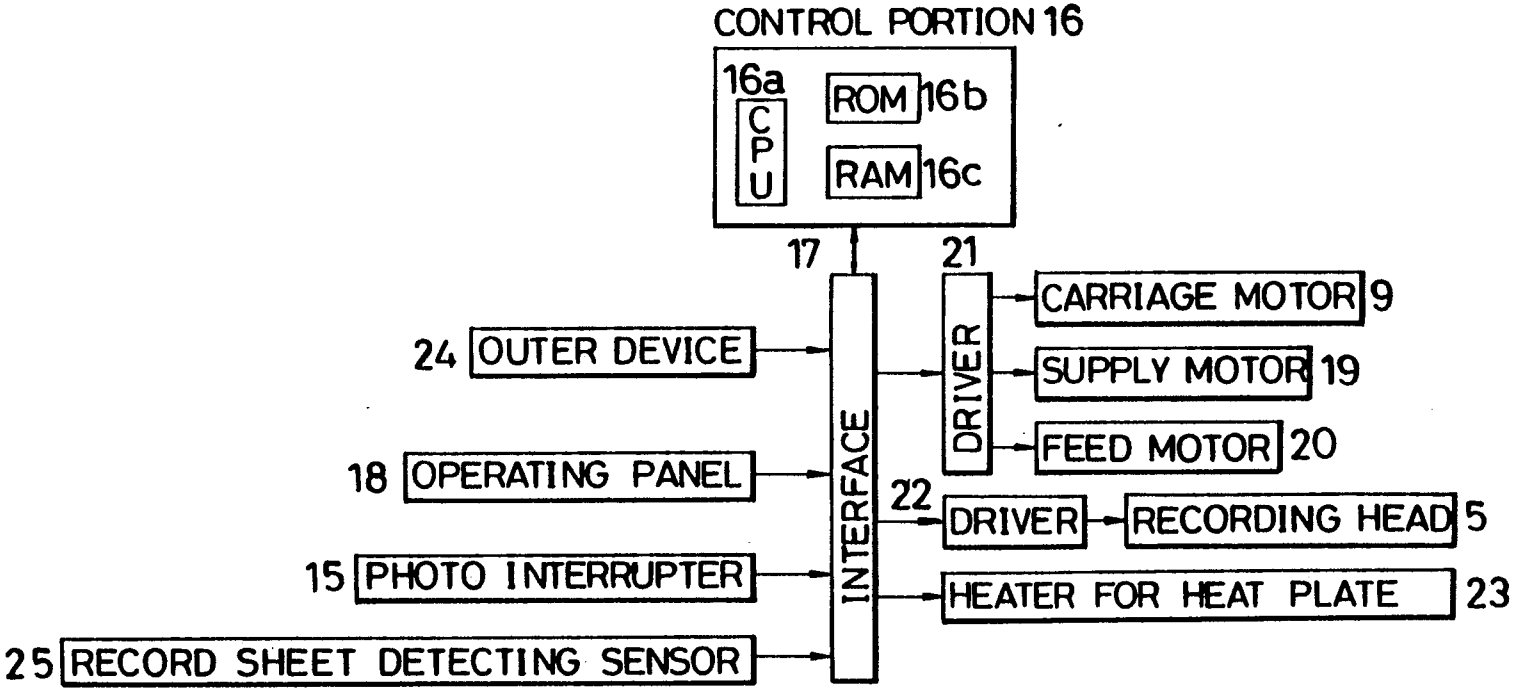
FIG. 2 is a control block diagram for the recording apparatus of FIG. 1.

FIG. 1 shows a schematic explanatory view of an ink jet recording apparatus, and FIG. 2 shows a control block diagram therefor.

In FIG. 1, recording sheets 1 each comprising a sheet member such as a paper, plastic sheet or the like are stacked in a cassette (not shown) and are supplied one by one by means of a supplying roller 2 driven by a supplying motor to a feeding means which will be described later, through an appropriate guide member (not shown).

The recording sheet 1 is pinched by a pair 3 of feed rollers and a pair 4 of ejector or discharge rollers, which roller pairs are spaced apart by a predetermined distance and are driven intermittently by respective feed motor (not shown) respectively, and is fed in a direction shown by the arrow A. The roller pair 3 is used for pinching (or gripping) and feeding the recording sheet 1 toward a recording portion which will be described later, and comprises a feed roller **3*a* and a follower roller 3*b* which are engaged by each other with the interposition of the recording sheet 1. The feed roller 3*a* is designed to be rotated by an appropriate driving source (not shown) in a direction shown by the arrow C. The roller pair 4 is used for gripping the recording sheet 1 on which the image has been recorded and which is being fed by the roller pair 3, to eject or discharge the recording sheet out of the recording apparatus, and comprises an ejector or discharge roller 4*a* and a follower roller 4*b* which are engaged by each other with the interposition of the recording sheet 1. The ejector roller 4*a*** is designed to be rotated by an appropriate driving source (not shown) in a direction shown by the arrow C.

The ejector roller **4*a* is rotated slightly faster than the feed roller 3*a* so that the recording sheet 1 does not slacken or loosen in the recording portion. Further, the feed roller 3a in the roller pair 3 has a width same as or wider than that of the recording sheet 1, whereas the follower roller 3b has a width narrower than that of the recording sheet so that a detecting roller or wheel (to be described later) can abut against the feed roller 3a with the interposition of the recording sheet 1 at one side of the follower roller 3b**.

An ink jet recording head 5 arranged in the recording portion and used for recording the image on the recording sheet 1 has an ink chamber therein and is designed to discharge the ink from a nozzle in response to an image signal. The recording head 5 is mounted on a carriage 6 which is connected to a carriage motor 9 through a belt 7 and pulleys 8a, 8b. Accordingly, by driving the carriage motor 9, the carriage 6 is reciprocally shifted along guide shafts 10.

A heating plate 11 having a heater therein is arranged on a back side of the recording sheet 1 between the feed roller pair 3 and the ejector roller pair 4. The heating plate 11 applies the heat to the back of the recording sheet 1 being fed, thereby drying the ink applied on the surface of the recording sheet 1 to fix the ink on the recording sheet.

With the above-mentioned arrangement, when the recording operation is started, the recording head 5 is shifted in a direction shown by the arrow B, during which the head 5 discharges the ink on the recording sheet 1 in response to the image signal, thereby recording an ink image on the recording sheet. After one line recording operation is completed, the recording head 5 returns to its home position, and the feed roller pair 3 and the ejector roller pair 4 are driven to feed the recording sheet 1 in the direction shown by the arrow A by a predetermined amount, i.e., by a distance corresponding to a width of one line. By repeating such recording operations, a desired image is recorded on the recording sheet 1.

The detecting wheel 12 used as a rotary member for detecting the amount of feed of the recording sheet 1 is arranged in alignment with the follower roller 3b to engage by the recording sheet on the feed roller 3a, and is rotatingly driven by the movement of the recording sheet 1. The detecting wheel 12 is connected at center thereof to a rotatable shaft 13, on the other end of which a disc-shaped encoder 14 is fixed. The encoder 14 is provided at its peripheral portion with a plurality of equidistantly spaced slits 14a and is rotated in response to the rotation of the detecting wheel 12. Further, the peripheral portion of the encoder 14 in which the slits 14a are formed passes through a recess or cavity 15a of a photo-interrupter 15. The photo-interrupter 15 emits a pulse signal whenever the slit 14a passes therethrough, whereby a control portion (described later) counts the number of such pulses, thus detecting the amount of feed of the recording sheet.

Next, a control system for driving the abovementioned recording apparatus will be explained.

As shown in a block diagram of FIG. 2, the control system comprises the aforementioned control portion 16 including a CPU 16a such as a microprocessor, a ROM 16b for storing a control program for the CPU 16a and other various data, and a RAM 16c used as a work area for the CPU 16a and used for temporally storing the various data; an inter face 17; an operating panel 18; a motor driver 21 for driving various motors (carriage motor 9, supply motor 19, feed motor 20); a head driver 22 for driving the recording head 5; a heater 23 for the heating plate 11; a recording sheet detecting sensor 25; and the aforementioned photo-interrupter 15.

The control portion 16 receives various informations (for example, density of image to be recorded, the number of sheets to be recorded, size of sheet to be recorded and the like) from the operating panel 18 and the pulse signals (regarding the slits 14a) from the photo-interrupter 15 through the interface 17, and further receives the image signal from an outer device 24. Further, the control portion 16 outputs ON/OFF signals for controlling the various motors, an ON/OFF signal for controlling the heating plate heater 23, and an image signal through the interface 17, whereby various members or elements are driven by such signals. Further, the recording sheet detecting sensor 25 detects a leading edge and a trailing edge of the recording sheet 1 fed between the feed roller pair 3 and the ejector roller pair 4, thereby controlling the motors for driving the roller pairs.

Next, an operation for detecting the amount of feed of the recording sheet when the recording apparatus is driven by the above-mentioned control system will now be explained with reference to a flow chart shown in FIG. 3. Incidentally, an example that the amount of feed of the recording sheet 1 is detected per each one line recording.

Figure 3:
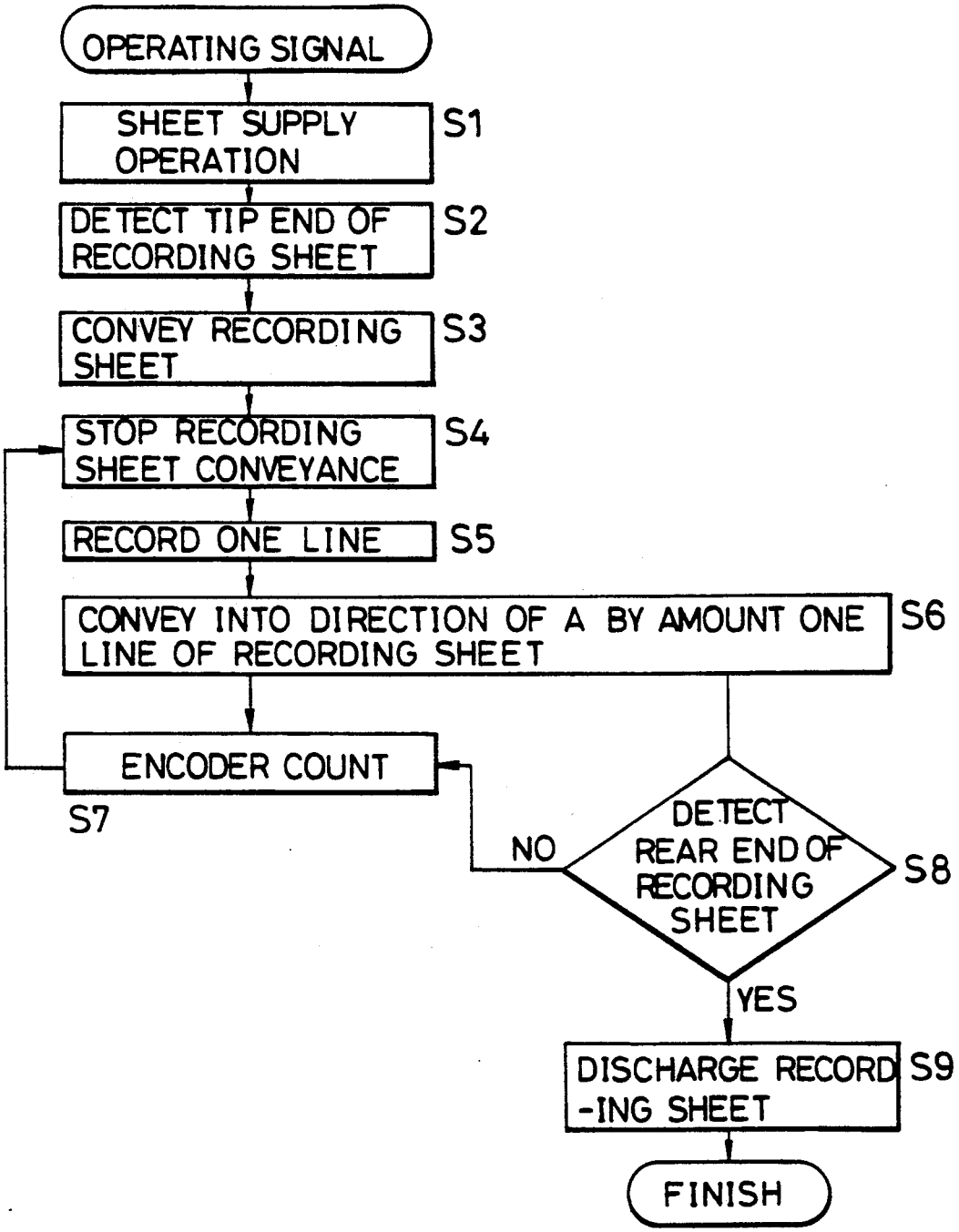
FIG. 3 is a flow chart for the operation of the recording apparatus of FIG. 1.

In FIG. 3, when an operating signal is inputted, the heater 23 is turned ON to heat the heating plate 11 up to a predetermined temperature in a condition that the recording sheet does not reach the heating plate 11, and after the predetermined temperature is reached, the supply motor 19 and the feed motor 20 are driven to rotate the supplying roller 2, feed roller pair 3 and ejector roller pair 4, thereby feeding the recording sheet 1 between the feed roller pair 3 and the ejector roller pair 4 (step S1).

Then, the leading edge of the recording sheet 1 fed between the feed roller pair 3 and the ejector roller pair 4 is detected by the detecting sensor 25 (the details thereof are not shown), and after the recording sheet 1 is fed by the predetermined amount, the feeding operation of the recording sheet by means of the various motors is temporally stopped (steps S2–S4).

Then, the recording operation is started, during which the carriage 6 is shifted in the direction shown by the arrow B in FIG. 1 and the recording head 5 discharges the ink onto the recording sheet 1 in response to the image signal, thus recording the ink image corresponding to one line on the recording sheet 1. When the one line recording is completed, the carriage 6 is returned to the home position and the recording sheet 1 is fed in the direction shown by the arrow A in FIG. 1 by a predetermined amount, i.e., by a distance corresponding to a width of one line (steps S5 and S6).

When the recording sheet 1 is fed by the one line as mentioned above, the detecting wheel 12 contacted with the recording sheet 1 is rotated in response to the feeding movement of the recording sheet 1. Accordingly, the encoder 14 connected to the detecting wheel 12 through the rotatable shaft 13 is also rotatingly driven, with the result that several slits 14a formed in the peripheral portion of the encoder 14 pass through the cavity 15a of the photo-interrupter 15, thus emitting the pulses (the number thereof corresponds to the number of slits passed through the cavity), which is counted in the control portion 16, thereby detecting the amount of feed of the recording sheet 1 (step S7). Accordingly, when the outer diameter of the detecting wheel 12 and the distance between two adjacent slits 14*a* are previously set or selected correctly, the amount of feed of the recording sheet 1 can be correctly determined b the rotational amount of the encoder 15.

After the one line recording is completed, if the trailing edge of the recording sheet 1 is not detected by the detecting sensor 25, when the number of pulses (generated by the movement of the slits 14*a* passing through the photo-interrupter 15) being counted reaches a predetermined value, the sequence returns to the step S4, where, by controlling to stop the feed roller 3*a*, the recording operation and the feeding operation for the recording sheet 1 are repeated. On the other hand, if the trailing edge of (rear end) the recording sheet 1 is detected by the detecting sensor 25, the ejector roller 4*a* is driven to eject or discharge the recording sheet 1 to an ejector tray (not shown), and the heater 23 is turned OFF to finish the operation (steps S8 and S9). In this way, it is possible to positively feed the recording sheet 1 by the predetermined amount, by detecting the rotational amount of the encoder 14 obtained by the rotation of the detecting wheel 12 rotating driven in response to the movement of the recording sheet 1 (by counting the number of the pulses emitted from the photo-interrupter 15), thus controlling the feeding operation of the recording sheet 1.

In the illustrated embodiment, while an example that the predetermined amount of feed of the recording sheet corresponds to the one line of the image was explained, such predetermined amount may correspond to two lines or a half of one line of the image, according to the dimension of the image.

Further, in the illustrated embodiment, an example of the ink jet recording apparatus was explained, the present invention may be adapted to other recording apparatuses such as a wire dot recording apparatus.

Next, an image forming apparatus (serial recording apparatus) according to another embodiment of the present invention will be explained with reference to FIG. 4 and FIG. 5 which shows a detailed portion of FIG. 4.

Figure 4:
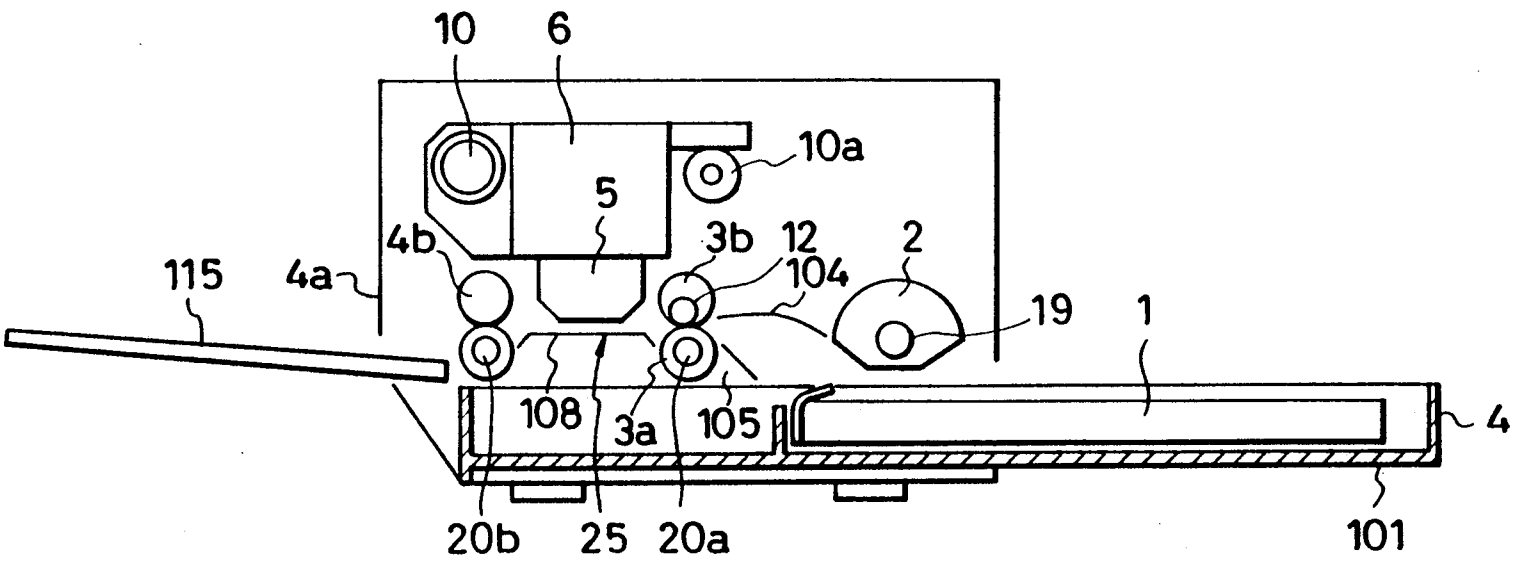
FIG. 4 is a schematic elevational view of a recording apparatus according to another embodiment of the present invention.
Figure 5:
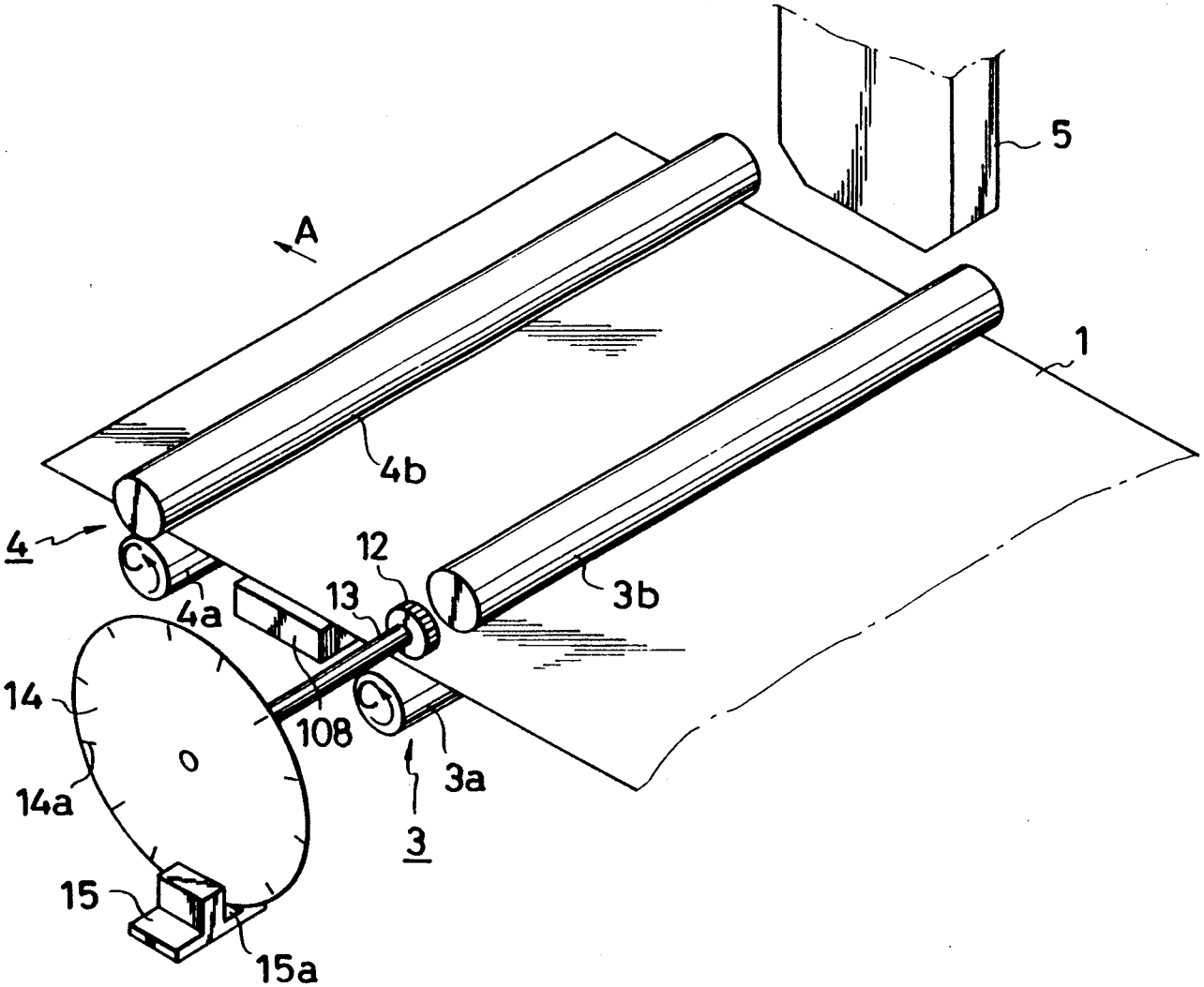
FIG. 5 is a perspective view of a main portion of the apparatus of FIG. 4.

In FIG. 4, recording sheets or sheet members 1 such as a plain paper, plastic sheet and the like are stacked in a cassette 101. The sheet members 1 in the cassette 101 are supplied one by one by a semi-cylindrical pick-up roller 2 (constituting a supplying means) rotated in response to a supply signal. The fed sheet member 1 is guided by upper and lower guides 104, 105 and is directed to a nip between a feed roller pair 3 temporally stopped.

A feed roller 3*a* in the feed roller pair 3 is rotatingly driven by a driving means 20*a* (the details thereof are not shown), and a feed roller 3*b* in the roller pair 3 is pressed against the feed roller 3*a* to form the nip therebetween and is rotatingly driven by the feed roller 3*a*, thus feeding the sheet member 1 steppingly toward a platen 108.

A recording head 5 arranged in confronting relation to the platen 108 has an ink jet nozzle capable of discharging the ink in response to an image signal, and an ink chamber communicated with the nozzle. The recording head 5 is mounted on a carriage 6 which can be reciprocally shifted along guide shafts 10, 11 parallel to the platen 108 in a direction perpendicular to a longitudinal direction of the sheet member 1, thereby performing the recording per one line. The carriage 6 is driven by a carriage motor connected to the carriage through a timing belt (not shown) would around pulleys (not shown).

A feeding speed of the sheet member 1 due to the feed roller pair 3 is previously determined in accordance with the width of 5*a* of the recording head 5. When the recording operation is started, the recording head 5 is shifted from the home position situated this side of FIG. 4 toward the opposite side of FIG. 4 and at the same time selectively discharges the ink in response to the image signal, thereby recording one line of the image. After the one line recording is completed, the recording head 5 returns to the home position and the sheet member 1 is fed by the predetermined amount, and then a next one line recording is started. By repeating such recording operations, a desired image is formed on the sheet member. When the recording operation for one page is completed, the sheet member 1 is fed by the ejector roller pair 4 to be ejected onto an ejector tray 115.

Incidentally, in FIG. 4, the reference numeral 19 designates a supply motor for driving the pick-up roller 2; 20*a* designates a feed motor for driving the feed roller 3*a*; and 20*b* designates a feed motor for driving the ejector roller 4*a*.

Figure 6:
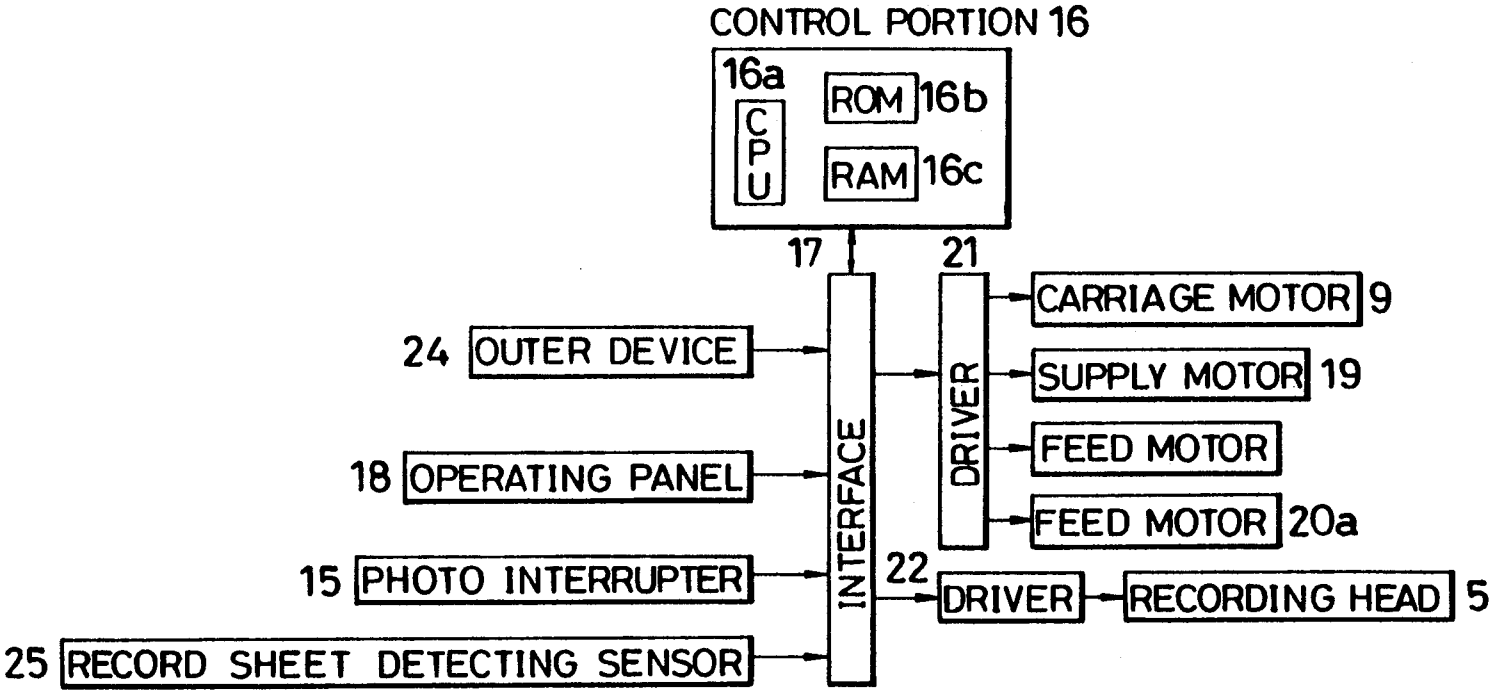
FIG. 6 is a control block diagram for the recording apparatus of FIG. 4.

A block diagram (for controlling the apparatus of FIG. 4) shown in FIG. 6 has a construction similar to that of FIG. 2, and, accordingly, the detailed explanation thereof will be omitted.

Figure 7:
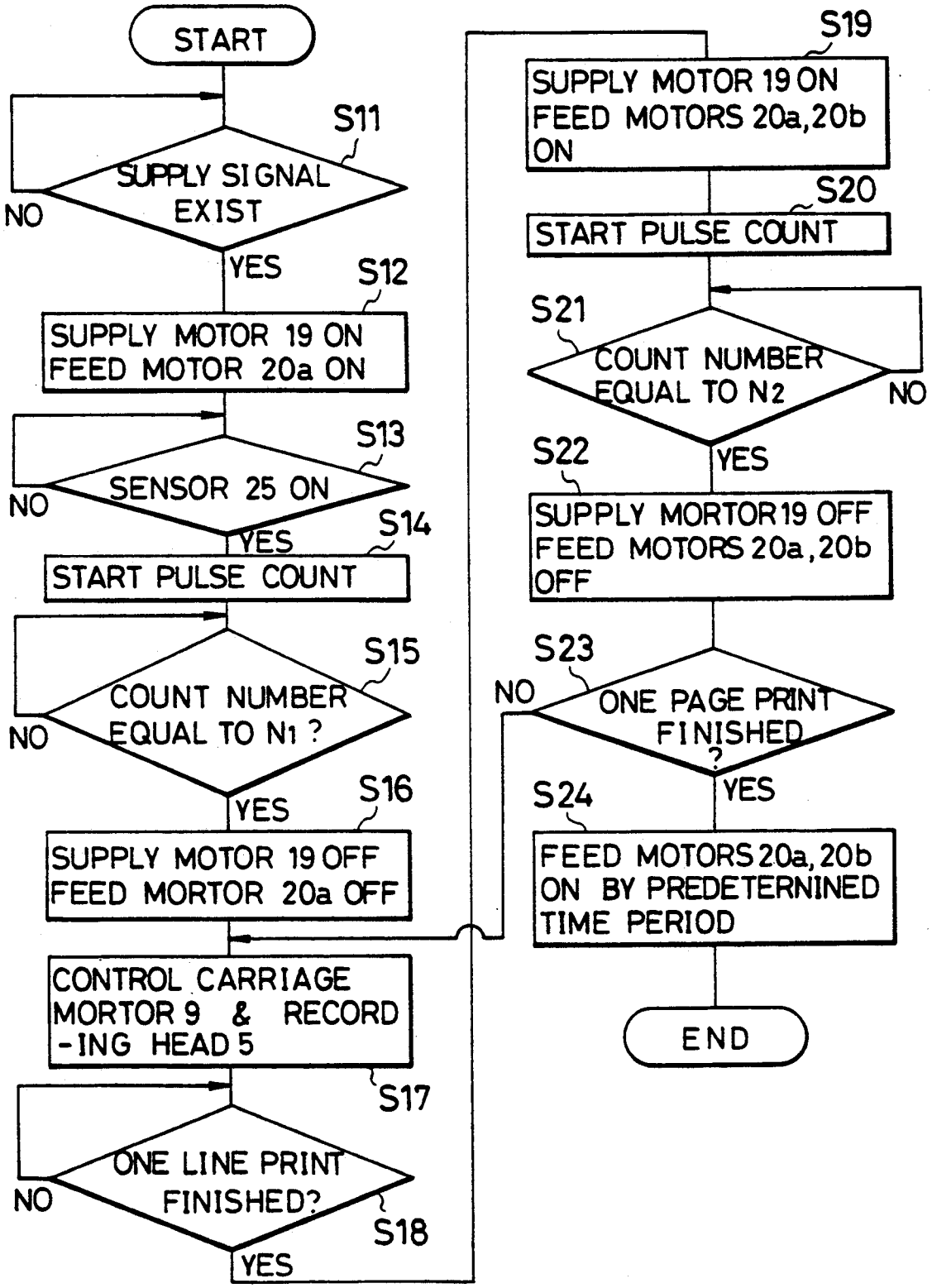
FIG. 7 is a flow chart for the operation of the recording apparatus of FIG. 4.

Next, an operation of the image forming apparatus of FIG. 4 will be explained with reference to a flow chart shown in FIG. 7. When the control portion 16 receives a supply signal from the outer device 24 such as a computer, word processor and the like, or from the operating panel 18 (step S11), the supply motor 19 and the feed motor 20*a* are turned ON, thus starting the rotations of the pick-up roller 2 and the feed roller 3*a* (step S12), whereby the sheet member 1 is picked up from the cassette 101 by the pick-up roller 2 and is then fed by the feed roller pair 3. When the leading edge of the sheet member 1 is detected by the recording sheet detecting sensor 25 (step S13), the CPU 16*a* starts to count the pulses from the photo-interrupter 15 (step S14). When the number of the counted pulses reaches a predetermined value $N_1$, i.e., when the sheet member 1 is fed by a predetermined distance $l_1$ from the position of the recording sheet detecting sensor 25 (step S15), the supply motor 19 and the feed motor 20*a* are turned OFF, thus stopping the feed of the sheet member 1 (step S16). Then, by controlling the carriage motor 9 and the recording head 5, a first one line recording (printing) is performed (step S17).

When the one line recording is finished (step S18), the supply motor 19 and the feed motors 20*a*, 20*b* are turned ON (step S19), the pulses from the photo-interrupter 15 are counted (step S20). When the number of the counted pulses reaches a predetermined value $N_2$, i.e., when a portion of the sheet member on which a next line of the character is to be recorded reaches the printing position (recording position) of the recording head 5 (step S21), the supply motor 19 and the feed motors 20*a*, 20*b* are turned OFF (step S22).

If the recording operation for one page has already been finished or completed (step S24), the feed motors 20*a* and 20*b* are turned ON for a predetermined time, thus ejecting the sheet member 1 onto the ejector tray 115. On the other hand, if the recording operation for one page has not yet been finished in the step S24, the sequence returns to the step S17, thus performing the next one line recording operation. In this way, the recording operations are repeated.

Incidentally, in the illustrated embodiment, while an example that the sheet member is fed each time when each one line recording is finished was explained, the present invention is not limited to this embodiment. For example, whenever the recording operations for a predetermined distance $l_2$ (corresponding to the total widths of a plurality of lines of the character or image) are finished, the sheet may be fed by such distance $l_2$.

Next, a means for detecting an amount of feed of a sheet member, according to a further embodiment of the present invention, will be explained with reference to FIG. 8.

Figure 8:
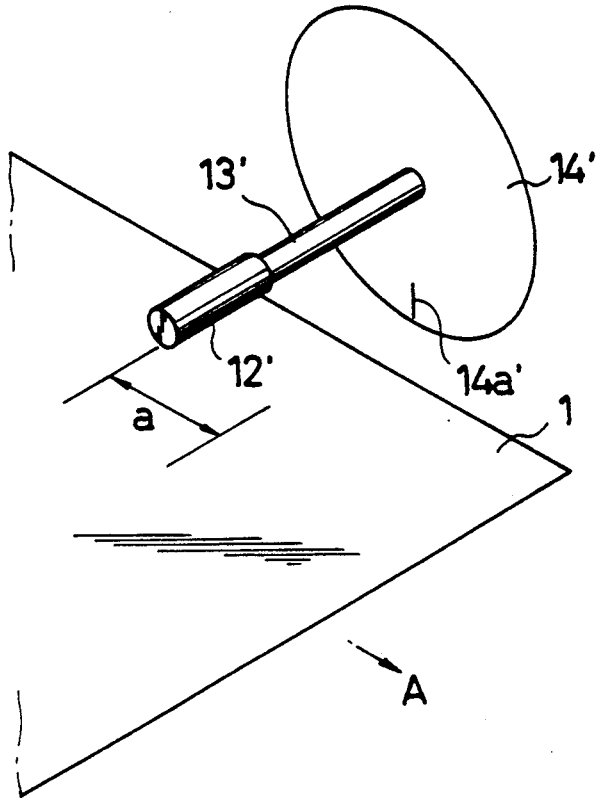
FIG. 8 is a perspective view of a main portion of a recording apparatus according to a further embodiment of the present invention.

In FIG. 8, a diameter of a detecting wheel 12' is previously set to have a value of $a/\pi$ (here, a is a predetermined value, i.e., a distance corresponding to a width of one line). That is to say, when the recording sheet or sheet member 1 is fed by the predetermined amount a, the detecting wheel 12' is rotated by one revolution. Further, a disc-shaped encoder 14' connected to the detecting wheel 12' through a rotatable shaft 13' is provided at its peripheral portion with a single slit 14a'. With this arrangement, when the recording sheet 1 is fed by the distance a, the encoder 14' is rotated by one revolution together with the detecting wheel 12', whereby the slit 14a' is detected by a photointerrupter 15. Accordingly, by controlling to stop the operation of the feed roller 3a when the photointerrupter 15 detects the slit 14a', it is possible to positively or correctly feed the recording sheet by the predetermined amount.

In the embodiment of FIG. 8, since the photo-interrupter 15 detects the single slit 14a' of the encoder 14', detection error will be reduced in comparison with the case where a plurality of slits are detected. That is to say, when the encoder has a plurality of slits, the detection error may be occurred due to the mechanical error in the distances between the adjacent slits, whereas, when the encoder has only one slit, the detection error due to such mechanical error does not exist. Further, in the case of the encoder having the plurality of slits, the detection error also arises due to the eccentricity of the encoder and/or detecting wheel which can not inevitably eliminated. On the other hand, in case of the encoder having the single slit, since the slit is detected per one revolution of the encoder, such detection error does not exist. Further, with the above-mentioned arrangement wherein the encoder has only one slit and the detecting wheel 12' is rotated by one revolution whenever the recording sheet is fed by the predetermined amount (width of one line), since it is not required to count the slit during the feeding of the recording sheet, more easier control can be obtained.

Figure 9:
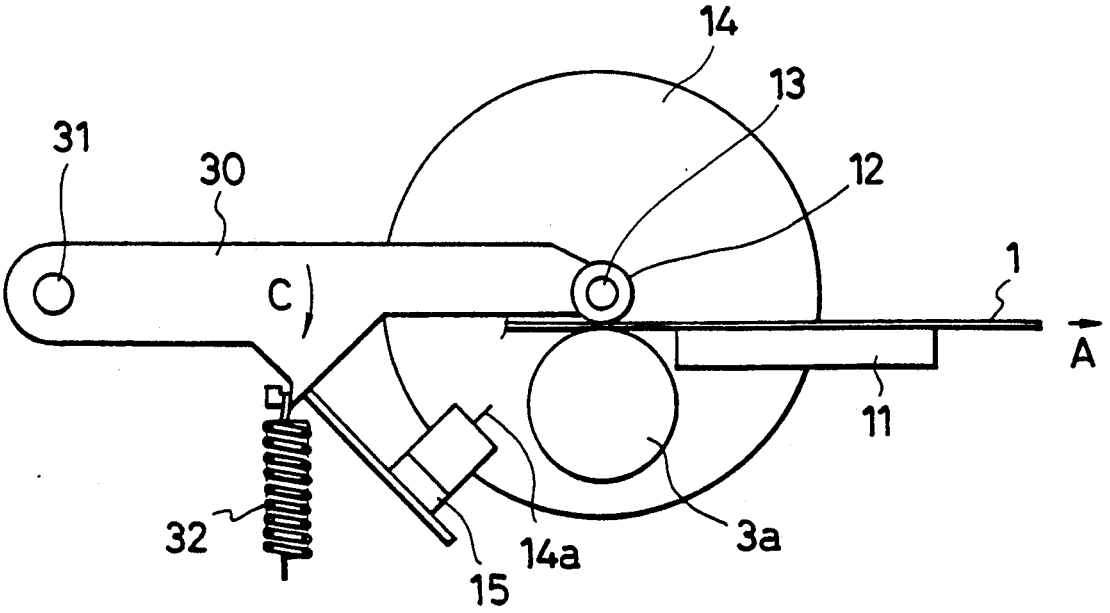
FIG. 9 is an elevational view showing a detecting roller means of the apparatus.

FIG. 9 shows a supporting means for the detecting wheel 12 (12') and the encoder 14 (14') used in the embodiments of FIGS. 1 to 8.

The rotatable shaft 13 of the detecting wheel 12 is rotatably supported by a supporting member 30. The supporting member 30 is biased by a spring 32 in a direction shown by the arrow C for pivotal movement around a pivot center 31, so that the detecting wheel 12 is always abutted against the recording sheet 1. With this arrangement, even when different kind of recording sheets are used and/or the thickness of the recording sheet is changed, since the detecting wheel can always closely engaged by the recording sheet, the amount of feed of the recording sheet can be always detected with high accuracy.

Incidentally, the surface of the detecting wheel may be constituted by material having high coefficient ($\mu$) of friction such as urethane material, in order to prevent the relative slip between the detecting wheel and the recording sheet. Preferably, in order to facilitate for obtaining the diameter of he detecting wheel with high accuracy, the detecting wheel composes a metallic body coated by sand blasting technique (abrasive grain is blown onto the metallic surface to obtain a rough surface).

Further, in the illustrated embodiments, the recording head 5 may be designed to discharge ink droplets onto the recording sheet by thermal energy, thereby forming the image on the recording sheet. Alternatively, the recording head may be constituted by a heat transfer recording head, or a wire dot type recording head.

What is claimed is:

1. An apparatus for feeding a sheet member, comprising:

feeding means for feeding a sheet member;

a rotary member engaged by the sheet member to be driven by the sheet member being fed by said feeding means;

signal generating means for generating a signal only once in every rotation of said rotary member; and a calculating means for calculating the predetermined length of the sheet member based on the signal generated at the signal generating means.

2. A sheet member feeding apparatus according to claim 1, wherein said signal generating means includes an encoder having a single slit formed therein.

3. A sheet member feeding apparatus according to claim 1, further comprising a control means for stopping the sheet member in response to the signal generated by said signal generating means.

4. A sheet member feeding apparatus according to claim 3, further comprising an image forming means for forming an image having a predetermined length in a feeding direction of the sheet member, and wherein a diameter of said rotary member is so selected that, when the sheet member is fed by a distance corresponding to said predetermined length, said rotary member is rotated by one revolution.

5. A sheet member feeding apparatus according to claim 4, wherein said control means stops the sheet member when said image having said predetermined width is being formed on the sheet member by said image forming means, and causes said feeding means to feed the sheet member until said signal generating means generates the signal after said image is formed.

6. A sheet member feeding apparatus according to claim 5, wherein the predetermined length of said image corresponds to one line of said image.

7. An image forming apparatus according to claim 4, wherein said image forming means has an ink jet head for discharging an ink droplet.

8. An image forming apparatus according to claim 7, wherein said ink jet head discharges the ink droplet by thermal energy.

9. An image forming apparatus according to claim 1, further having pressing means for pressing said rotary member onto the sheet.

10. An image forming apparatus, comprising:

feeding means for feeding a sheet member;

image forming means for forming an image line by line on the sheet member fed by said feeding means, the image of each line having a predetermined length in a feeding direction of the sheet member;

a rotary member in contact with the sheet member to be rotatingly driven by the sheet member fed by said feeding means, said rotary means being rotated one rotation for every feeding of the sheet member by an amount equal to the predetermined length;

a detecting means for detecting one rotation of said rotary member; and control means for controlling the image formation of each line of the predetermined length in the feeding direction by said image forming means and controlling feeding of the sheet member in said predetermined length by said feeding means, and controlling feeding of the sheet member by the predetermined length upon detection of only one rotation of said rotary member by said detection means.

11. An image forming apparatus according to claim 10, wherein said image forming means forms said image by liquid droplets generated by thermal energy.

12. An image forming apparatus according to claim 10, wherein said image forming means has an ink jet head for discarding the ink droplet.

13. An image forming apparatus according to claim 10, wherein said rotary member has a single slit.

14. An image forming apparatus according to claim 13, wherein said detecting means has a photo-interrupter for detecting the slit.

15. An image forming apparatus according to claim 10, further having pressing means for pressing said rotary member onto the sheet.

* * * * *

UNITED STATES PATENT AND TRADEMARK OFFICE

CERTIFICATE OF CORRECTION

PATENT NO. : 5,131,770

DATED : July 21, 1992

INVENTOR(S) : Shinji KANEMITSU

It is certified that error appears in the above-identified patent and that said Letters Patent is hereby corrected as shown below:

IN THE DRAWINGS

FIGURE 7

"MORTOR" (all three occurrences) should read --MOTOR--.

COLUMN 4

Line 43, "temporally" should read --temporarily--.

COLUMN 5

Line 3, "b" should read --by--.

COLUMN 6

Line 5, "of" (first occurrence) should be deleted.

COLUMN 7

Line 43, "can not" should read --cannot be--.
Line 65, "can" should read --can be--.

UNITED STATES PATENT AND TRADEMARK OFFICE

CERTIFICATE OF CORRECTION

PATENT NO. : 5,131,770

DATED : July 21, 1992

INVENTOR(S) : Shinji KANEMITSU

It is certified that error appears in the above-identified patent and that said Letters Patent is hereby corrected as shown below:

COLUMN 8

Line 6, "be" should read --the--.

COLUMN 10

Line 8, "discarding" should read --discharging--.

Signed and Sealed this

Seventh Day of September, 1993

Bruce Lehman

*Attest:*

BRUCE LEHMAN

*Attesting Officer*

*Commissioner of Patents and Trademarks*